US009725271B2

(12) United States Patent
Oba et al.

(10) Patent No.: US 9,725,271 B2
(45) Date of Patent: Aug. 8, 2017

(54) TENSION CONTROL METHOD, AND PRINTING DEVICE

(71) Applicant: SEIKO EPSON CORPORATION, Tokyo (JP)

(72) Inventors: Masashi Oba, Nagano (JP); Daiki Tokushima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 14/536,044

(22) Filed: Nov. 7, 2014

(65) Prior Publication Data

US 2015/0166289 A1 Jun. 18, 2015

(30) Foreign Application Priority Data

Dec. 17, 2013 (JP) ..... 2013-259814

(51) Int. Cl.

| | |
|---|---|
| ***B65H 23/185*** | (2006.01) |
| ***B65H 23/182*** | (2006.01) |
| ***B65H 23/188*** | (2006.01) |
| ***B65H 23/192*** | (2006.01) |
| ***B65H 23/195*** | (2006.01) |
| ***B65H 23/198*** | (2006.01) |

(52) U.S. Cl.

CPC ..... *B65H 23/1825* (2013.01); *B65H 23/185* (2013.01); *B65H 23/1888* (2013.01); *B65H 23/192* (2013.01); *B65H 23/198* (2013.01); *B65H 23/1955* (2013.01); *B65H 2404/14* (2013.01); *B65H 2511/142* (2013.01); *B65H 2513/108* (2013.01); *B65H 2513/11* (2013.01); *B65H 2515/31* (2013.01); *B65H 2553/212* (2013.01); *B65H 2801/15* (2013.01)

(58) Field of Classification Search

CPC ..... B65H 23/1825; B65H 23/185; B65H 23/1888; B65H 23/192; B65H 23/198; B65H 23/1955

See application file for complete search history.

(56) References Cited

U.S. PATENT DOCUMENTS

| | | | | |
|---|---|---|---|---|
| 4,347,993 A * | 9/1982 | Leonard | B65H 23/1955 242/413.3 |
| 2007/0039495 A1* | 2/2007 | Sakamoto | B65H 20/02 101/228 |
| 2012/0280076 A1* | 11/2012 | Schultze | B65H 23/1825 242/419.8 |

FOREIGN PATENT DOCUMENTS

| | | |
|---|---|---|
| JP | 2003-146508 A | 5/2003 |
| JP | 2004-142418 A | 5/2004 |
| JP | 2007-039161 A | 2/2007 |
| JP | 2012-126529 A | 7/2012 |

* cited by examiner

*Primary Examiner* — Sang Kim

(74) *Attorney, Agent, or Firm* — Global IP Counselors, LLP

(57) ABSTRACT

A method includes, a first step of starting rotation of a rotating axle, which is configured to detachably support a web, in a direction in which the web is wounded onto the rotating axle, a second step of detecting a tension applied to the web after the first step, a third step of performing open loop control on torque applied to the rotating axle until the tension greater than a designated value is detected with the second step, and a fourth step of performing feedback control on the torque applied to the rotating axle based on the detection value of the tension applied to the web after the tension greater than the designated value is detected with the second step.

11 Claims, 8 Drawing Sheets

TENSION CONTROL METHOD, AND PRINTING DEVICE

CROSS-REFERENCE TO RELATED APPLICATIONS

This application claims priority to Japanese Patent Application No. 2013-259814 filed on Dec. 17, 2013. The entire disclosure of Japanese Patent Application No. 2013-259814 is hereby incorporated herein by reference.

BACKGROUND

Technical Field

The present invention relates to technology for controlling web tension when conveying a web using roll-to-roll or the like, for example.

Related Art

Described in Japanese Unexamined Patent Publication No. 2012-126529 is an image recording device for conveying roll paper by rotating a roll paper holder for supporting roll paper. With this image recording device, it is possible to attach and detach roll paper on the roll paper holder. Therefore, the operator can suitably execute the work of attaching roll paper to the roll paper holder.

However, when rotating the rotating axle that supports a web such as roll paper and conveying the web, it is not possible to suitably convey the web if the web is in a slack state. Therefore, when starting conveying of the web, it is preferable to support the web on the rotating axle in a state without slack. However, attaching the web to the rotating axle without slack is not necessarily easy for the operator.

SUMMARY

This invention was created considering the problems noted above, and an object is to provide technology that is able to take up slack of the web supported on the rotating axle.

To achieve the object noted above, the tension control method of one aspect of the present invention includes starting rotation of a rotating axle, which is configured to detachably support a web, in a direction in which the web is wounded onto the rotating axle, detecting a tension applied to the web after the starting of the rotation, performing open loop control on a torque applied to the rotating axle until the tension greater than a designated value is detected in the detecting of the tension, and performing feedback control on the torque applied to the rotating axle based on a detection value of the tension applied to the web, after the tension greater than the designated value is detected in the detecting of the tension.

To achieve the object noted above, the printing device of the present invention is equipped with a rotating axle that detachably supports a web, a detector that can detect tension applied to the web, and a control unit that detects tension applied to the web using the detector after rotation of the rotating axle is started in the direction with which the web is wound onto the rotating axle, performs open loop control on the torque applied to the rotating axle when the detection value of the tension is a designated value or less, and performs feedback control on the torque applied to the rotating axle based on the detection value of the tension applied to the web detected by the detector when the detection value of the tension is greater than the designated value.

With the invention constituted in this way (tension control method, printing device), the web is detachably supported on the rotating axle, so when the web is attached to the rotating axle, there is the risk of the web having slack. In contrast to this, with the present invention, rotation of the rotating axle is started in the direction that winds the web (first step). Therefore, it is possible to wind the web on the rotating axle and take up the slack of the web.

Furthermore, when tension greater than the designated value is detected, feedback control based on the detection value is started on the torque applied to the rotating axle (step 2). With this constitution, the slack of the web is taken up, and when tension greater than the designated value is detected, feedback control is done on the torque applied to the rotating axle based on the detection value of the detector, so it is possible to stabilize the tension of the web.

Incidentally, before taking up the slack of the web, tension is not applied to the web, so it is not necessarily desirable to perform this feedback control. In other words, when performing feedback control, because the web has slack, despite the fact that it is in a state for which tension cannot be applied to the web, when an attempt is made to give tension to the web and the torque applied to the rotating axle continues to increase, as a result, there is a risk that the rotating axle will rotate at a high speed, or that the moment the slack is taken up on the web, a huge tension will work on the web and the web will be damaged. In contrast to this, specifically, before the slack is taken up on the web, when the detection value of the tension is the designated value or less, open loop control is performed on the torque applied to the rotating axle. In this way, by constituting this such that feedback control is not executed before the slack is taken up for the web, it is possible to suppress high speed rotation of the rotating axle, and the web being damaged.

At this time, the tension control method can also be constituted such that until the tension greater than the designated value is detected at the second step, the rotating axle is rotated at a fixed torque. With this constitution, before the slack is taken up for the web, it is possible to suppress high speed rotation of the rotating axle, and damage to the web.

The tension control method can also be constituted such that until the tension greater than the designated value is detected at the second step, the rotating axle is rotated at a torque of a designated torque or less. With this constitution, before the slack is taken up for the web, it is possible to suppress high speed rotation of the rotating axle, and damage to the web.

The tension control method can also be constituted such that until the tension greater than the designated value is detected at the second step, the rotating axle is rotated at a torque that is a designated torque or less and is a torque that increases as time elapses.

Alternatively, the tension control method can also be constituted such that when the tension greater than the designated value is detected at the second step, the rotation of the rotating axle is stopped. With this constitution, it is possible to take up the slack of the web by rotating the rotating axle, and also possible to, after the slack of the web is taken up, stop the rotation of the rotating axle, and to be equipped with web conveyance from after the state when the slack of the web is taken up.

Also, the tension control method can also be constituted such that while the tension greater than the designated value is applied to the web, the rotating axle is rotated at a first speed and the web is conveyed, and until the tension greater than the designated value is detected at the second step, the rotating axle is rotated at a second speed smaller than the first speed. With this constitution, when conveying the web, the rotating axle is rotated at the relatively fast first speed. Meanwhile, when taking up the slack of the web, the rotating axle is rotated at the relatively slower second speed, so it is possible to suppress the size of the tension acting on the web at the moment the slack of the web is taken up, and to suppress the occurrence of damage to the web or the like.

However, there are cases when the operator makes an error with the orientation for attaching the web to the rotating axle. In such a case, when the rotating axle is rotated in the direction that winds the web, the web is not wound onto the rotating axle, but conversely is fed out from the rotating axle. In light of that, the tension control method can also be constituted such that at the second step, when it is not possible to detect tension greater than the designated value even when rotation of the rotating axle continues for a designated time, the rotation of the rotating axle in the direction in which the web is wound onto the rotating axle is stopped. By doing this, it is possible to limit to some degree the volume of web that is fed out from the rotating axle in accordance with rotation of the rotating axle due to an error in the orientation of attaching the web.

At this time, the tension control method can also be constituted such that at the second step, when it is not possible to detect tension greater than the designated value even when rotation of the rotating axle continues for a designated time, an abnormality is notified. By doing this, it is possible for the operator to become aware of the error of the orientation for attaching the web, and to execute a suitable operation.

Also, the tension control method can also be constituted such that at the third step, when the torque applied to the rotating axle is a designated torque or less, while feedback control is performed on the torque applied to the rotating axle based on the detection value of the tension applied to the web, after the torque applied to the rotating axle exceeds the designated torque, open loop control is performed on the torque applied to the rotating axle. With this constitution, since feedback control is done on the torque applied to the rotating axle based on the tension detection value, it is possible to stabilize the tension of the web. In fact, feedback control is executed when the torque applied to the rotating axle is less than the designated torque, and is not executed when that torque exceeds the designated torque. By doing this, having the torque become excessive is suppressed by the feedback control. In other words, for example, when the web is in a slack state, it is not possible to give tension to the web when the torque applied to the rotating axle is increased. Therefore, when feedback control is performed, despite the fact that it is in a state for which tension cannot be applied to the web because the web has slack, there is the risk that an increase in the torque applied to the rotating axle in an attempt to give tension to the web will continue to increase, and as a result, the rotating axle will rotate at high speed, or huge tension will work at the moment the slack is taken up from the web and damage will occur to the web. In contrast to this, when the torque given to the rotating axle exceeds the designated torque, by not executing feedback control, it is possible to suppress having the rotating axle rotate at high speed, or having the web be damaged.

The tension control method can also be constituted such that during conveying of the web, the rotating axle is a feed shaft that feeds the web by rotating in the direction in reverse to the direction in which the web is wounded onto the rotating axle. With this constitution, the web is wound onto the feed shaft, and it is possible to take up the slack of the web.

Also, the tension control method can also be constituted such that during conveying of the web, the rotating axle is a take-up shaft that winds the web by rotating in the direction in which the web is wounded onto the rotating axle. With this constitution, the web is wound onto the take-up shaft, and it is possible to take up the slack of the web.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
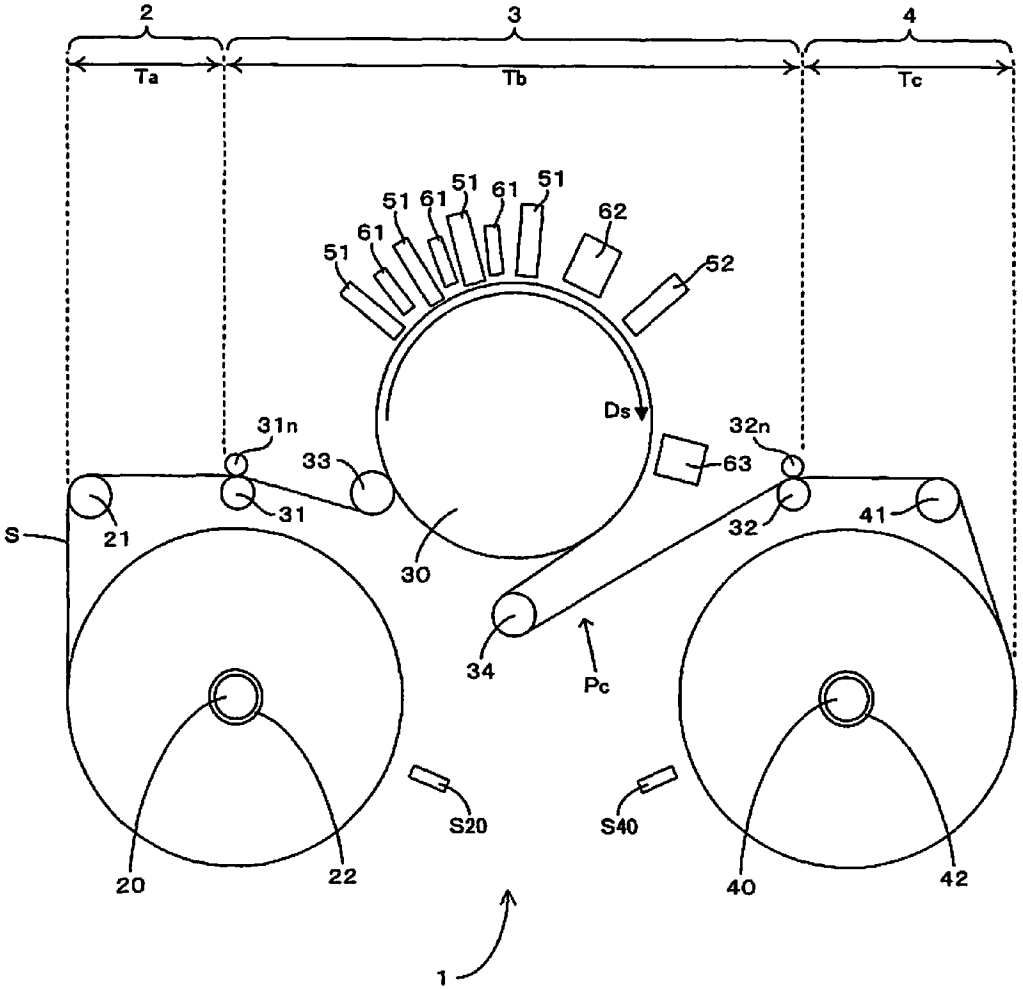
FIG. 1 is a drawing showing an example of a device constitution equipped with a printer capable of executing the present invention.

FIG. 1 is a drawing schematically showing an example of a device constitution equipped with a printer capable of executing the present invention. As shown in FIG. 1, with the printer 1, one sheet S (web) for which both ends are wound in roll form on a feed shaft 20 and a take-up shaft 40 is stretched along a conveyance path Pc, and the sheet S undergoes image recording while being conveyed in a conveyance direction Ds facing from the feed shaft 20 to the take-up shaft 40. The sheet S types are roughly divided into paper and film. To list specific examples, for paper, there is high quality paper, cast coated paper, art paper, coated paper and the like, and for film, there is synthetic paper, PET (Polyethylene terephthalate), PP (polypropylene) and the like. Schematically, the printer 1 is equipped with a feed unit 2 (feed area) that feeds the sheet S from the feed shaft 20, a processing unit 3 (processing area) that records an image on the sheet S fed from the feed unit 2, and a take-up unit 4 (take-up area) that takes up the sheet S on which the image is recorded by the processing unit 3 by the take-up shaft 40. With the description hereafter, of the two surfaces of the sheet S, the surface on which the image is recorded is called the front surface, and the reverse side surface to that is called the back surface.

The feed unit 2 has the feed shaft 20 on which the end of the sheet S is wound, and a driven roller 21 that winds the sheet S pulled from the feed shaft 20. In a state with the front surface of the sheet S facing the outside, the feed shaft 20 winds and supports the end of the sheet S. Also, by rotating the feed shaft 20 clockwise in FIG. 1, the sheet S wound on the feed shaft 20 is fed via the driven roller 21 to the processing unit 3. Incidentally, the sheet S is wound on the feed shaft 20 via a core tube 22 that can be attached and detached with the feed shaft 20. Therefore, when the sheet S of the feed shaft 20 is used up, a new core tube 22 on which the sheet S is wound in roll form is mounted on the feed shaft 20, making it possible to replace the sheet S of the feed shaft 20. Furthermore, a roll radius sensor S20 for detection the roll radius of the sheet S wound into roll form on the feed shaft 20 is provided on the feed unit 2.

The processing unit 3 performs processing as appropriate using each functional unit 51, 52, 62, 63, and 63 arranged along the outer circumference surface of a rotating drum 30 while supporting the sheet S fed from the feed unit 2 on the rotating drum 30, and records an image on the sheet S. With this processing unit 3, a front drive roller 31 and a rear drive roller 32 are provided at both sides of the rotating drum 30, the sheet S conveyed from the front drive roller 31 to the rear drive roller 32 is supported on the rotating drum 30, and it undergoes image recording.

The front drive roller 31 has a plurality of minute projections formed by thermal spraying on the outer circumference surface, and the sheet S fed from the feed unit 2 is wound from the back surface side. Also, by the front drive roller 31 rotating clockwise in FIG. 1, the sheet S fed from the feed unit 2 is conveyed to the downstream side of the conveyance path. A nip roller 31*n* is provided on the front drive roller 31. This nip roller 31*n* abuts the front surface of the sheet S in a state biased to the front drive roller 31 side, and the sheet S is sandwiched between it and the front drive roller 31. By doing this, frictional force is ensured between the front drive roller 31 and the sheet S, and it is possible to reliably perform conveying of the sheet S by the front drive roller 31.

The rotating drum 30 is supported so as to be able to rotate in both directions of the conveyance direction Ds and the reverse direction to that using a support mechanism (not illustrated), and for example is a cylindrical shaped drum having a diameter of 400 [mm], and the sheet S conveyed from the front drive roller 31 to the rear drive roller 32 is wound from the back surface side. This rotating drum 30 is an item that receives friction force with the sheet S, and the sheet S is supported from the back surface side while doing following rotation in the conveyance direction Ds of the sheet S. Incidentally, with the processing unit 3, driven rollers 33 and 34 that fold back the sheet S are provided at both sides of the winding part onto the rotating drum 30. Of these, the driven roller 33 winds the front surface of the sheet S between the front drive roller 31 and the rotating drum 30, and folds back the sheet S. Meanwhile, the driven roller 34 winds the front surface of the sheet S between the rotating drum 30 and the rear drive roller 32, and folds back the sheet S. In this way, by folding back the sheet S respectively at the upstream and downstream side of the conveyance direction Ds in relation to the rotating drum 30, it is possible to ensure a long winding part of the sheet S onto the rotating drum 30.

The rear drive roller 32 has a plurality of minute projections formed using thermal spraying on the outer circumference surface, and the sheet S conveyed via the drive roller 34 from the rotating drum 30 is wound from the back surface side. Also, by the rear drive roller 32 rotating clockwise in FIG. 1, the sheet S is conveyed to the take-up unit 4. A nip roller 32*n* is provided on the rear drive roller 32. This nip roller 32*n* abuts the front surface of the sheet S in a state biased to the rear drive roller 32 side, and the sheet S is sandwiched between it and the rear drive roller 32. By doing this, friction force between the rear drive roller 32 and the sheet S is ensured, and it is possible to reliably perform conveyance of the sheet S by the rear drive roller 32.

In this way, the sheet S conveyed from the front drive roller 31 to the rear drive roller 32 is supported on the outer circumference surface of the rotating drum 30. Also, with the processing unit 3, a plurality of recording heads 51 corresponding to mutually different colors are provided for recording a color image on the front surface of the sheet S supported on the rotating drum 30. In specific terms, four recording heads 51 corresponding to yellow, cyan, magenta, and black are aligned in the conveyance direction Ds in this color sequence. Each recording head 51 faces the surface of the sheet S rolled onto the rotating drum 30 with a slight clearance left open, and ink of the corresponding color (colored ink) is discharged from the nozzle using the inkjet method. Then, by ink being discharged by each recording head 51 on the sheet S conveyed in the conveyance direction Ds, a color image is formed on the surface of the sheet S.

Incidentally, as the ink, UV (ultraviolet) ink that is cured by the irradiation of ultraviolet rays (light) (photocurable ink) is used. In light of that, with the processing unit 3, to cure the ink and fix it to the sheet S, UV irradiators 61 and 62 (light irradiating units) are provided. This ink curing is executed divided into two stages of preliminary curing and main curing. The UV irradiator 61 for preliminary curing is arranged between each of the plurality of recording heads 51. In other words, the UV irradiators 61, by irradiating ultraviolet light of weak irradiation strength, cure the ink to a level for which the ink wetting and spreading is sufficiently slow (preliminary curing) compared to when ultraviolet light is not irradiated, and do not do main curing of the ink. On the other hand, the UV irradiator 62 for doing main curing is provided at the downstream side of the conveyance direction Ds in relation to the plurality of recording heads 51. In other words, the UV irradiator 62 does curing to the level at which the ink wetting and spreading is stopped (main curing) by irradiating ultraviolet light of a stronger irradiation strength than the UV irradiators 61.

In this way, the UV irradiators 61 arranged between each of the plurality of recording heads 51 do preliminary curing of the colored ink discharged on the sheet S from the recording heads 51 on the upstream side of the conveyance direction Ds. Therefore, the ink discharged on the sheet S by one recording head 51 undergoes preliminary curing by the time it reaches the adjacent recording head 51 to the one recording head 51 at the downstream side of the conveyance direction Ds. By doing this, the occurrence of mixed colors by which colored inks of different colors are mixed together is suppressed. In this kind of state with mixed colors suppressed, the plurality of recording heads 51 discharge colored inks having mutually different colors, and form a color image on the sheet S. The UV irradiator 62 for main curing is provided further to the downstream side in the conveyance direction Ds than the plurality of recording heads 51. Because of that, the color image formed using the plurality of recording heads 51 undergoes main curing by the UV irradiator 62 and is fixed on the sheet S.

Furthermore, the recording head 52 is provided at the downstream side of the conveyance direction Ds in relation to the UV irradiator 62. This recording head 52 faces opposite the surface of the sheet S rolled onto the rotating drum 30 with a slight clearance left open, and discharges transparent UV ink onto the surface of the sheet S from nozzles using the inkjet method. In other words, transparent ink is further discharged onto the color image formed using the four colors of recording heads 51. This transparent ink is discharged on the entire surface of the color image, and gives the color image a feeling of glossiness or matte finish. Also, a UV irradiator 63 is provided to the downstream side of the conveyance direction Ds in relation to the recording head 52. By this UV irradiator 63 irradiating strong ultraviolet light, it does main curing of the transparent ink discharged by the recording head 52. By doing this, it is possible to fix the transparent ink to the sheet S surface.

In this way, with the processing unit 3, ink discharge and curing are suitably executed on the sheet S wound onto the outer circumference part of the rotating drum 30, and a color image coated with transparent ink is formed. Then, the sheet S on which this color image is formed is conveyed to the take-up unit 4 by the rear drive roller 32.

In addition to the take-up shaft 40 on which the end of the sheet S is wound, this take-up unit 4 has a driven roller 41 on which the sheet S is wound from the back surface side between the take-up shaft 40 and the rear drive roller 32. In a state with the front surface of the sheet S facing the outside, the take-up shaft 40 winds up and supports the end of the sheet S. In other words, when the take-up shaft 40 rotates clockwise in FIG. 1, the sheet S conveyed from the rear drive roller 32 is wound onto the take-up shaft 40 via the driven roller 41. Incidentally, the sheet S is wound onto the take-up shaft 40 via a core tube 42 that can be attached and detached with the take-up shaft 40. Therefore, it is possible to remove the sheet S for each core tube 42 when the sheet S wound onto the take-up shaft 40 becomes full. Furthermore, the roll radius sensor S40 that detects the roll radius of the sheet S wound into roll form on the take-up shaft 40 is provided on the take-up unit 4.

Figure 2:
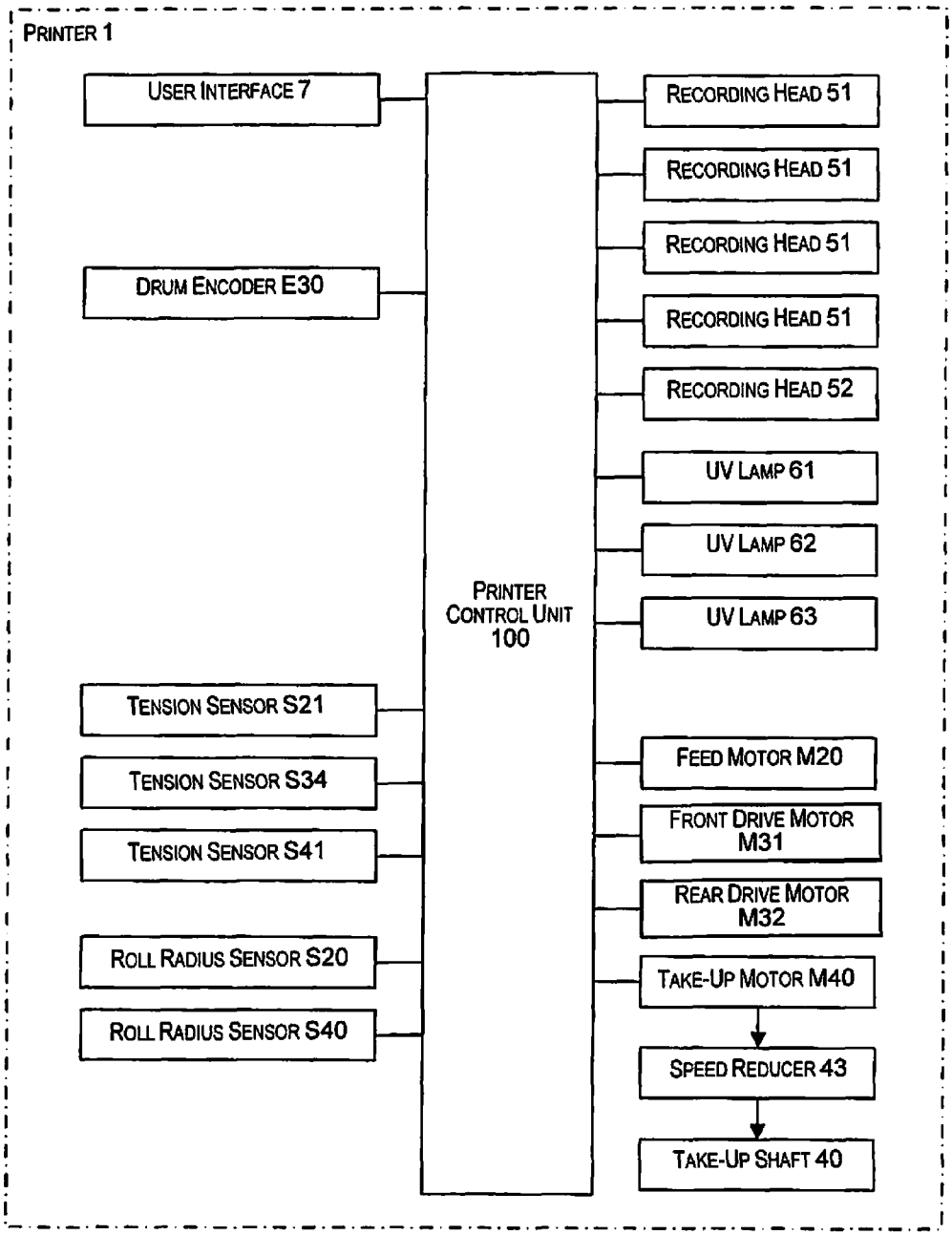
FIG. 2 is a drawing showing an example of an electrical constitution for controlling the printer shown in FIG. 1.

The above was a summary of the device constitution of the printer 1. Next, we will describe the electrical constitution for controlling the printer 1. FIG. 2 is a block diagram schematically showing an example of an electrical constitution for controlling the printer shown in FIG. 1. A printer control unit 100 that controls each part of the printer 1 is provided with the printer 1. Also, each device part including the recording head, the UV irradiator, and the sheet conveyance system is controlled by the printer control unit 100. The details of control by the printer control unit 100 on each of these device parts are as noted hereafter.

The printer control unit 100 controls the ink discharge timing of each recording head 51 for forming color images according to the conveyance of the sheet S. More specifically, this ink discharge timing control is executed based on the output (detection value) of a drum encoder E30 that is attached to the rotating shaft of the rotating drum 30 and detects the rotation position of the rotating drum 30. In other words, the rotating drum 30 does driven rotation following the conveyance of the sheet S, so if the output of the drum encoder E30 that detects the rotation position of the rotating drum 30 is referenced, it is possible to grasp the conveyance position of the sheet S. In light of that, the printer control unit 100 generates pts (print timing signal) signals from the output of the drum encoder E30, and by controlling the ink discharge timing of each recording head 51 based on the pts signal, the ink discharged by each recording head 51 is made to impact target positions on the conveyed sheet S, and a color image is formed.

Also, the timing for the recording head 52 to discharge the transparent ink is similarly controlled by the printer control unit 100 based on the output of the drum encoder E30. By doing this, it is possible to suitably discharge transparent ink on the color image formed by the plurality of recording heads 51. Furthermore, the light on and off timing and the irradiated light volume of the UV irradiators 61, 62, and 63 are also controlled by the printer control unit 100.

Also, the printer control unit 100 is in charge of the function of controlling the conveyance of the sheet S described in detail using FIG. 1. In other words, of the members constituting the sheet conveyance system, a motor is connected respectively to the feed shaft 20, the front drive roller 31, the rear drive roller 32, and the take-up shaft 40. Also, the printer control unit 100 controls the speed and torque of each motor while rotating these motors, and controls the conveyance of sheet S. The details of this sheet S conveyance control are as noted hereafter.

The printer control unit 100 rotates a feed motor M20 that drives the feed shaft 20 and supplies the sheet S from the feed shaft 20 to the front drive roller 31. At this time, the printer control unit 100 controls the torque of the feed motor M20, and adjusts the sheet S tension (feed tension Ta) from the feed shaft 20 to the front drive roller 31. In other words, a tension sensor S21 that detects the size of the feed tension Ta is attached to the driven roller 21 arranged between the feed shaft 20 and the front drive roller 31. This tension sensor S21 can be constituted by load cells that detect the size of the force received from the sheet S, for example. Also, the printer control unit 100 does feedback control of the torque of the feed motor M20 based on the detection results (detection value) of the tension sensor S21 and adjusts the feed tension Ta of the sheet S.

Also, the printer control unit 100 rotates the front drive motor M31 that drives the front drive roller 31 and the rear drive motor M32 that drives the rear drive roller 32. By doing this, the sheet S fed from the feed unit 2 passes through the processing unit 3. At this time, while speed control is executed on the front drive motor M31, torque control is executed on the rear drive motor M32. In other words, the printer control unit 100 adjusts the rotation speed of the front drive motor M31 to be constant based on the encoder output of the front drive motor M31. By doing this, the sheet S is conveyed at a constant speed by the front drive roller 31.

Meanwhile, the printer control unit 100 adjusts the tension of the sheet S (process tension Tb) from the front drive roller 31 to the rear drive roller 32 by controlling the torque of the rear drive motor M32. In other words, a tension sensor S34 that detects the size of the process tension Tb is attached to the driven roller 34 arranged between the rotating drum 30 and the rear drive roller 32. This tension sensor S34 can for example be constituted using load cells that detect the size of the force received from the sheet S. Also, the printer control unit 100 adjusts the process tension Tb of the sheet S by doing feedback control of the torque of the rear drive motor M32 based on the detection results (detection value) of the tension sensor S34.

Also, the printer control unit 100 rotates the take-up motor M40 connected to the take-up shaft 40 via the speed reducer 43, and winds the sheet S conveyed by the rear drive roller 32 onto the take-up shaft 40. At this time, the printer control unit 100 controls the torque of the take-up motor M40 and adjusts the tension of the sheet S (take-up tension Tc) from the rear drive roller 32 to the take-up shaft 40. In other words, a tension sensor S41 that detects the size of the take-up tension Tc is attached to the driven roller 41 arranged between the rear drive roller 32 and the take-up shaft 40. This tension sensor S41 can be constituted, for example, by load cells that detect the size of the force received from the sheet S. Also, the printer control unit 100 does feedback control of the torque of the take-up motor M40 based on the detection results (detection value) of the tension sensor S41 and adjusts the take-up tension of the sheet S. Incidentally, in order to execute tapered tension that reduces the take-up tension Tc as the roll radius of the sheet S supported on the take-up shaft 40 increases, the printer control unit 100 controls the take-up tension Tc while changing the target value of the take-up tension Tc according to the detection value of the roll radius sensor S40.

The printer 1 is equipped with a user interface 7, and the operator can input instructions to the user interface 7, and look at the user interface 7 to confirm the status of the printer 1. In correspondence to this, the printer control unit 100 controls each part of the printer 1 according to the instructions input to the user interface 7, and displays the status of the printer 1 on the user interface 7.

Figure 3:
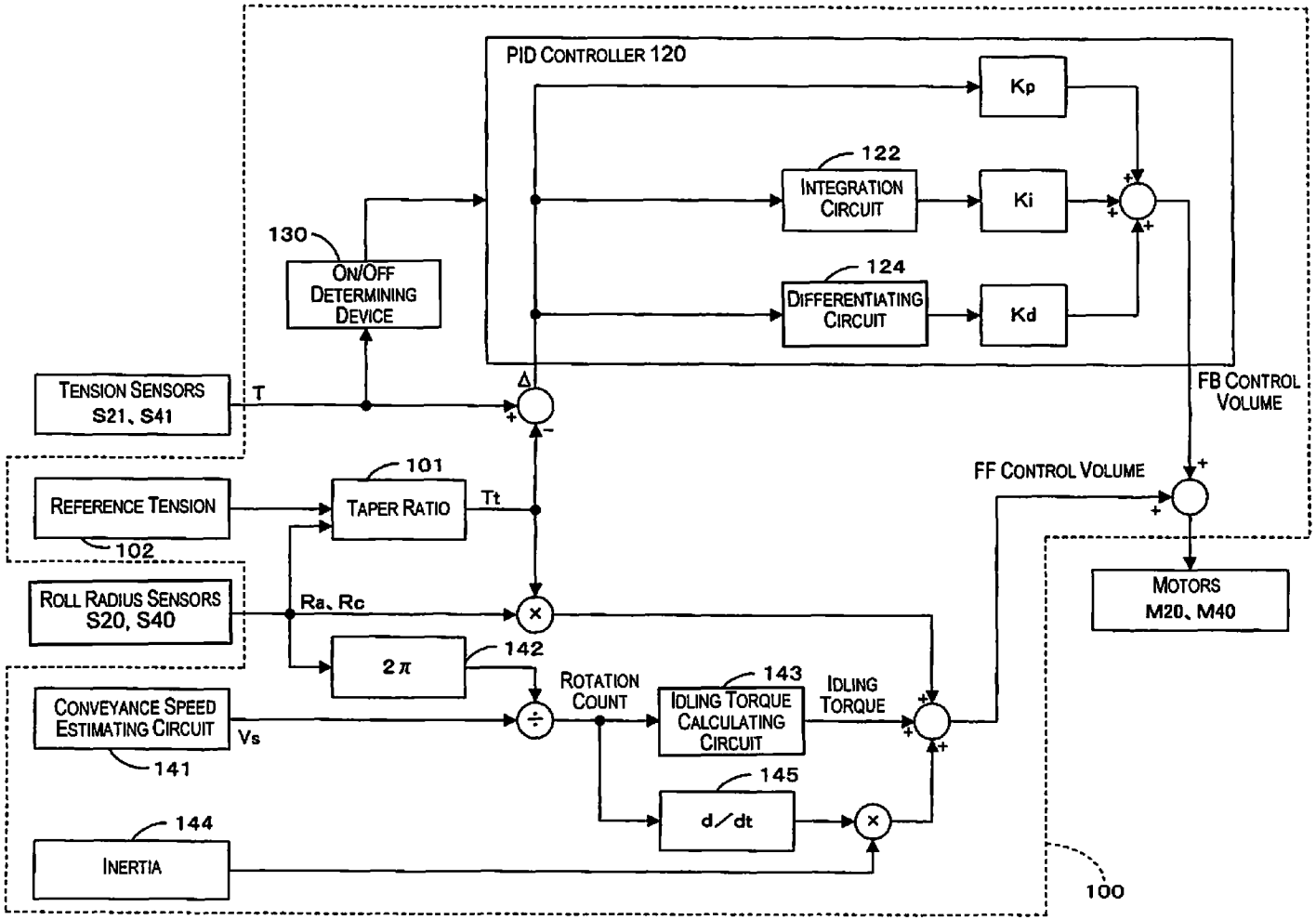
FIG. 3 is a drawing showing an example of tension control with the first embodiment.

FIG. 3 is a block diagram showing an example of feed tension and take-up tension control with the first embodiment. The constitution for controlling tension shown in FIG. 3 has the feed shaft 20 and the take-up shaft 40 provided individually, but both of these are roughly the same except for the presence or absence of tapered tension, so we will describe these together here. In the drawing, the constitution built into the printer control unit 100 is shown inside a dashed line. The printer control unit 100 has a FB (Feed Back) system for performing feedback control based on the FB control volume, and a FF (Feed Forward) system for performing feed forward control based on the FF control volume. The FB system does feedback control of the output torque of the motors M20 and M40 based on the FB control volume found from the detection values of the tension sensors S21 and S41. The FF system does feed forward control of the output torque of the motors M20 and M40 based on the FF control volume found from the roll diameter, the conveyance speed (estimated value) of the sheet S, and the inertia of the sheet conveyance system.

First, we will describe the FB system. This FB system performs feedback control based on the deviation Δ between the tension T (feed tension Ta, take-up tension Tc) detected by the tension sensors S21 and S41, and the target tension Tt. At this time, with the feedback control on the feed shaft 20, the target tension Tt is fixed and does not depend on the roll radius Ra. On the other hand, with the feedback control on the take-up shaft 40, the taper tension described above is executed. In other words, the printer control unit 100 reduces the target tension Tt when performing feedback control on the take-up shaft 40 in accordance with an increase in the detection value Rc of the roll radius sensor S40. In specific terms, the printer control unit 100 stores in the internal memory a taper ratio 101 which shows the change rate of the tension T in relation to the roll radius Rc, and a reference tension 102 which is the reference value of the tension T. Then, by multiplying the taper ratio 101 according to the detection value Rc of the roll radius sensor S40 by the reference tension 102, the target tension Tt is calculated. Incidentally, with the feedback control to the feed shaft 20, the taper tension is not performed, so the taper ratio 101 is eliminated, and the reference tension 102 becomes the target tension Tt.

Next, with the printer control unit 100, the target tension Tt is subtracted from the tension T value detected using the tension sensors S21 and S41 to obtain the deviation Δ (=T−Tt), and a PID controller 120 does PID control on the output torque of the motors M20 and M40 based on the deviation Δ. This PID controller 120 performs proportional calculation of multiplying a proportional gain Kp on the deviation Δ, integration calculation of multiplying an integration gain Ki on the value for which the deviation Δ was integrated at the integration circuit 122, and differential calculation of multiplying a differential gain Kd on the value for which the deviation Δ was differentiated with the differentiating circuit 124. Also, the FB control volume is found by adding the values found respectively with the proportion calculation, the integration calculation, and the differential calculation, and feedback control is done on the output torque of the motors M20 and M40 based on this FB control volume.

Also, the printer control unit 100 is equipped with an On/Off determining device 130 that turns on and off the PID controller 120 based on the tension T detected by the tension sensors S21 and S41. Therefore, when the On/Off determining device 130 turns the PID controller 120 on, feedback control is executed by the PID controller 120. On the other hand, when the On/Off determining device 130 turns the PID controller 120 off, feedback control is not executed by the PID controller 120. The operation of the On/Off determining device 130 will be described in detail later.

Next, we will describe the FF system. With the FF system, the FF control volume is found by adding each of the three terms (three terms) based respectively on the roll radius, the sheet S conveyance speed (estimated value), and the sheet conveyance system inertia. In other words, as the first term, the torque which is the roll radius Ra and Rc of the sheet S supported on the rotating axle (feed shaft 20, take-up shaft 40) multiplied by the target tension Tt (Ra×Tt, Rc×Tt) is found. As the second term, the idling torque necessary to idle the rotating axles 20 and 40 (constant speed rotation) was found based on the rotation count of the rotating axles 20 and 40 found from the conveyance speed of the sheet S. In specific terms, the conveyance speed Vs of the sheet S is estimated using a conveyance speed estimating circuit 141. At this time, the conveyance speed of the sheet S can be found from the detection value of the drum encoder E30, for example, or can be found from the elapsed time from the start of conveyance of the sheet S while referencing the acceleration and deceleration pattern of the sheet S acquired in advance. In parallel, the values for which the roll radius Ra and Rc are multiplied by 2n are found (2n×Ra, 2n×Rc) (in the drawing, "142"). Then, the rotation count of the rotating axles 20 and 40 by the conveyance speed Vs being divided by 2n×Ra and 2n×Rc is found (Vs/(2n×Ra), Vs/(2n×Rc)), and an idling torque calculating circuit 143 finds the idling torque based on this rotation count. As the third term, the torque is found for which the value for which the rotation count is differentiated by the differentiating circuit 145 is multiplied on the inertia 144 stored in the internal memory of the printer control unit 100 (inertia when the rotating axles 20 and 40 are rotated). Then, the torque of each term is added to find the FF control volume, and feed forward control is done on the output torque of the motors M20 and M40 based on this FF control volume.

With the printer 1 constituted as noted above, the operator can load the sheet S on the rotating axles 20 and 40. For example, loading of the sheet S onto the feed shaft 20 can be executed by attaching a new roll form sheet S to the feed shaft 20 and connecting the pulled sheet S to the processing unit 3. Alternatively the loading of the sheet S to the take-up shaft 40 can be executed by removing the roll form sheet S for which printing has ended from the take-up shaft 40, and pulling out the sheet S tightened on the processing unit 3 and attaching it to the take-up shaft 40.

Figure 4:
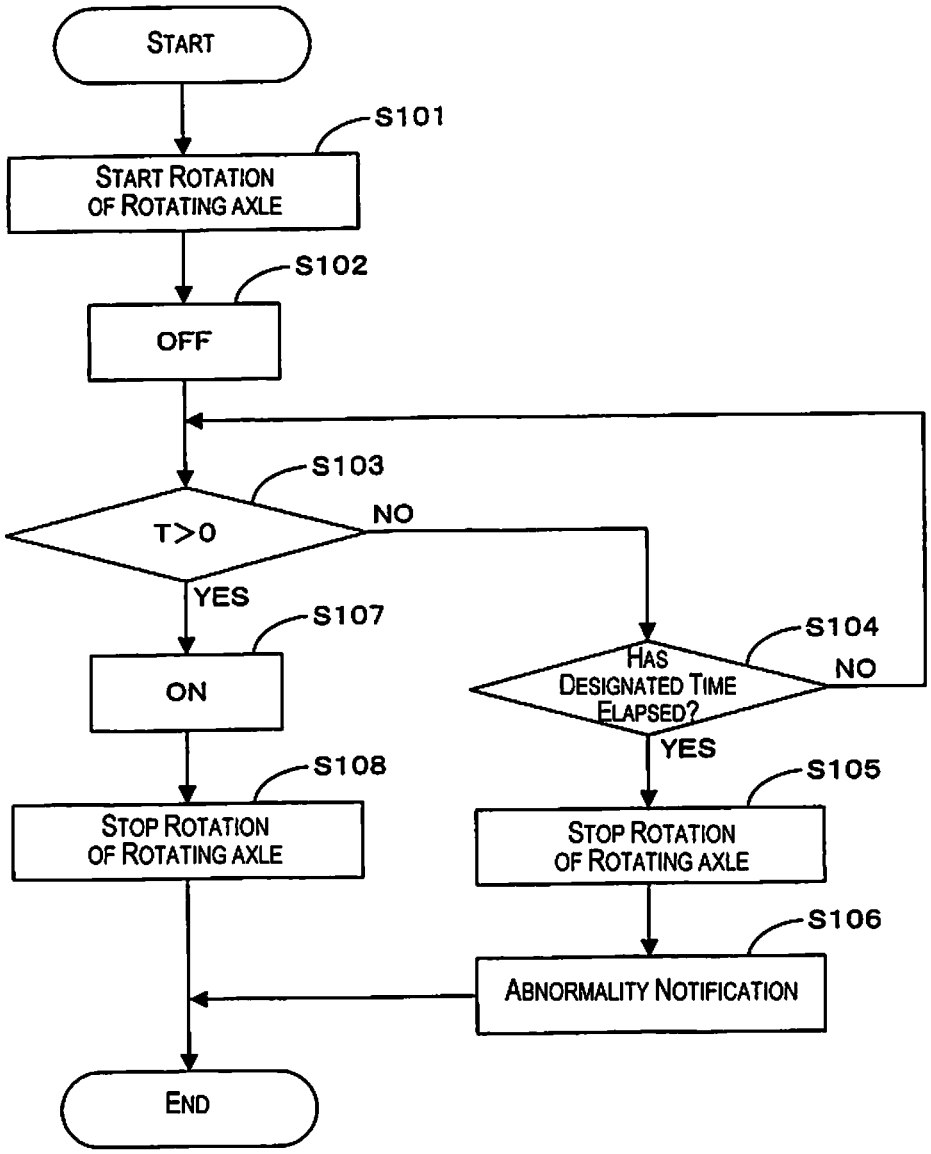
FIG. 4 is a drawing showing an example of the operation when a sheet is loaded with the first embodiment.

Also, when the sheet S is loaded onto the rotating axles 20 and 40, the printer control unit 100 of this embodiment executes the operation of winding the sheet S onto the rotating axles 20 and 40 and taking up the slack of the sheet S. FIG. 4 is a flow chart showing an example of the operation executed by the printer control unit when the sheet is loaded on the rotating axle with the first embodiment. The operation shown in FIG. 4 is executed individually respectively for the feed shaft 20 and the take-up shaft 40, but both of these are roughly the same, so here we will describe them together.

When the sheet S is loaded onto the rotating axles 20 and 40, the flow chart of FIG. 4 is executed. At this time, loading of the sheet S onto the rotating axles 20 and 40 can be judged based on the input to that effect to the user interface 7 by the operator, or can be judged based on changes in the output values of the roll radius sensors S20 and S40.

At step S101, rotation of the rotating axles 20 and 40 is started, and after that, the rotating axles 20 and 40 receive a fixed torque from the motors M20 and M40 and rotate. Incidentally, when the sheet S is loaded on the feed shaft 20, the feed shaft 20 rotates in the reverse direction (counter-clockwise direction in FIG. 1) to the rotation direction (clockwise direction in FIG. 1) when conveying the sheet S in the conveyance direction Ds. By doing this, the slack of the sheet S is wound onto the feed shaft 20. Also, when conveying the sheet S, the size that the speed at which the feed shaft 20 rotates when winding the slack of the sheet S (second speed) has is set to be smaller than the size that the speed at which the feed shaft 20 rotates when conveying the sheet S (first speed) has. In other words, the slack of the sheet S is wound up while rotating the feed shaft 20 relatively slowly. On the other hand, when the sheet S is loaded onto the take-up shaft 40, the take-up shaft 40 rotates in the rotation direction (clockwise direction in FIG. 1) when conveying the sheet S in the conveyance direction Ds. By doing this, the slack of the sheet S is wound onto the take-up shaft 40. Incidentally, the size that the speed at which the take-up shaft 40 rotates (second speed) when winding the slack of the sheet S has is set to be smaller than the size of the speed at which the take-up shaft 40 rotates (first speed) when conveying the sheet S has. In other words, the take-up shaft 40 winds the slack of the sheet S while rotating relatively slowly.

At step S102, the On/Off determining device 130 turns the feedback control by the PID controller 120 off. By doing this, open loop control on the torque given to the rotating axles 20 and 40 is started. Step S102 is not limited to the timing shown by example here, but can also be executed simultaneously with step S101 or before step S101. With the subsequent step S103, the On/Off determining device 130 determines whether or not the tension T detected by the tension sensors S21 and S41 is greater than "0." Then, if taking up of the slack of the sheet S has not ended, and the tension T is equal to "0" (when "No" at step S103), the process advances to step S104, and a determination is made of whether a designated time has elapsed. The starting point of the designated time can be the timing at which rotation of the rotating axles 20 and 40 started, for example.

When it is determined that the designated time has elapsed (when "Yes" at step S104), the rotation of the rotating axles 20 and 40 is stopped (step S105), and the operator is notified of an abnormality via the user interface 7 (step S106). The sequence of steps S105 and S106 is not limited to this, and can be simultaneous or can be reversed in terms of before and after. On the other hand, when it is determined that the designated time has not elapsed (when "No" at step S104), the process returns to step S103.

Then, when winding of the slack of the sheet S loaded on the rotating axles 20 and 40 ends, tension T is given to the sheet S. As a result, at step S103, it is determined that the tension T is greater than "0." When the On/Off determining device 130 receives this, it turns on the feedback control by the PID controller 120 (step S108), and stops the rotation of the rotating axles 20 and 40 (step S108). In this way, it is possible to support the sheet S on the rotating axles 20 and 40 while giving the tension T that has undergone feedback control based on the detection values of the tension sensors S21 and S41. Furthermore, when conveying the sheet S thereafter, it is possible to give to the sheet S the tension T that has undergone feedback control based on the detection values of the tension sensors S21 and S41.

As described above, with this embodiment, rotation of the sheet S in the winding direction is started with the rotating axles 20 and 40. Therefore, it is possible to take up slack of the sheet S by winding the sheet S onto the rotating axles 20 and 40.

At this time, the printer control unit 100 controls the rotation of the rotating axles 20 and 40 based on the detection of the tension T greater than the designated value (zero) by the tension sensors S21 and S41 that detect the tension T of the sheet S. In other words, by continuing rotation of the rotating axles 20 and 40, at the point that the slack of the sheet S is taken up, a large tension T occurs on the sheet S. Therefore, the detection values of the tension sensors S21 and S41 can be the reference for whether or not the slack of the sheet S has been taken up. In light of that, with this embodiment, by controlling the rotation of the rotating axles 20 and 40 based on the fact that the tension T greater than the designated value (zero) was detected by the tension sensors S21 and S41, it is possible to perform suitable control according to the slack state of the sheet S.

For example, when the tension sensors S21 and S41 detect the tension T greater than the designated value (zero), feedback control based on the detection values of the tension sensors S21 and S41 is started on the output torque to the rotating axles 20 and 40. With this constitution, after the slack of the sheet S is taken up, by doing feedback control of the output torque to the rotating axles 20 and 40 based on the detection values of the tension sensors S21 and S41, it is possible to stabilize the tension of the sheet S. On the other hand, before the slack of the sheet S is taken up, the tension T is not given to the sheet S, so it is not necessarily suitable to perform that feedback control. In other words, when feedback control is performed, despite being in a state for which the tension T cannot be given to the sheet S because the sheet S is slack, when an attempt is made to give the tension T to the sheet S and the output torque to the rotating axles 20 and 40 continues to be increased, as a result, the rotating axles 20 and 40 rotate at high speed, and there is the risk that a huge tension T will work on the sheet S at the moment the slack of the sheet S is taken up, and that the sheet S will be damaged. In contrast to this, before the slack of the sheet S is taken up, open loop control is executed, and feedback control is not executed. By doing this, it is possible to suppress high speed rotation of the rotating axles 20 and 40, and damage to the sheet S. In this way, it is possible to execute suitable control on the tension T of the sheet S according to whether it is before or after taking up of the slack of the sheet S.

Figure 5:
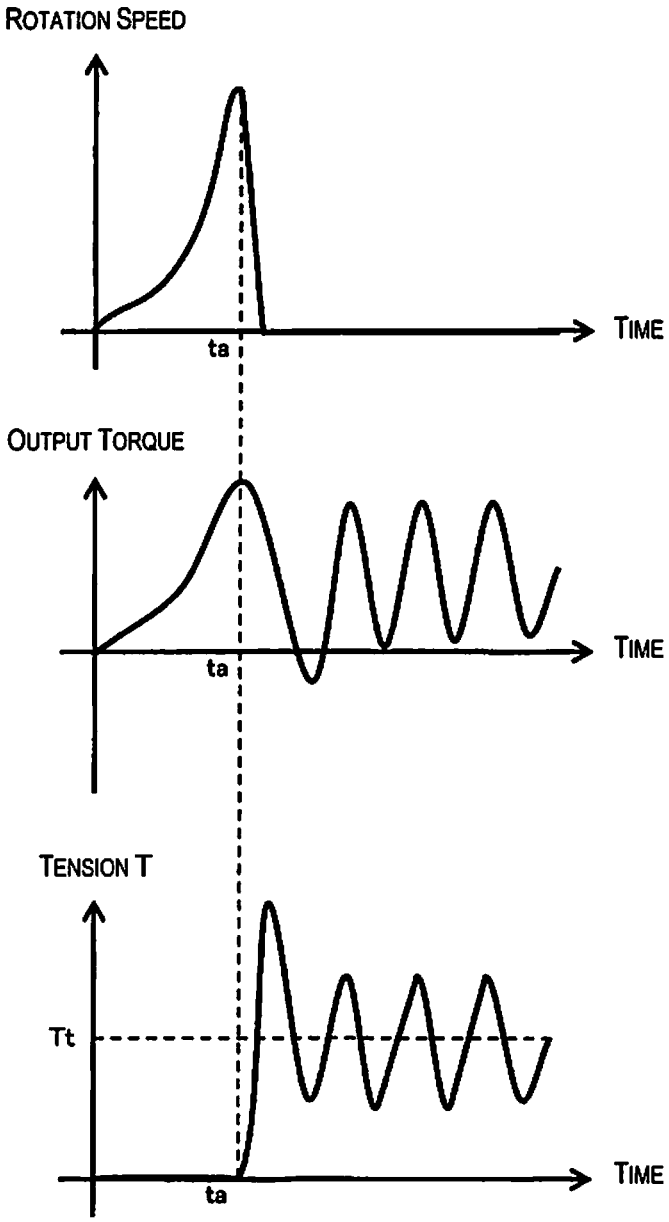
FIG. 5 is a drawing schematically showing an example of the action before and after the slack of the sheet is taken up.
Figure 6:
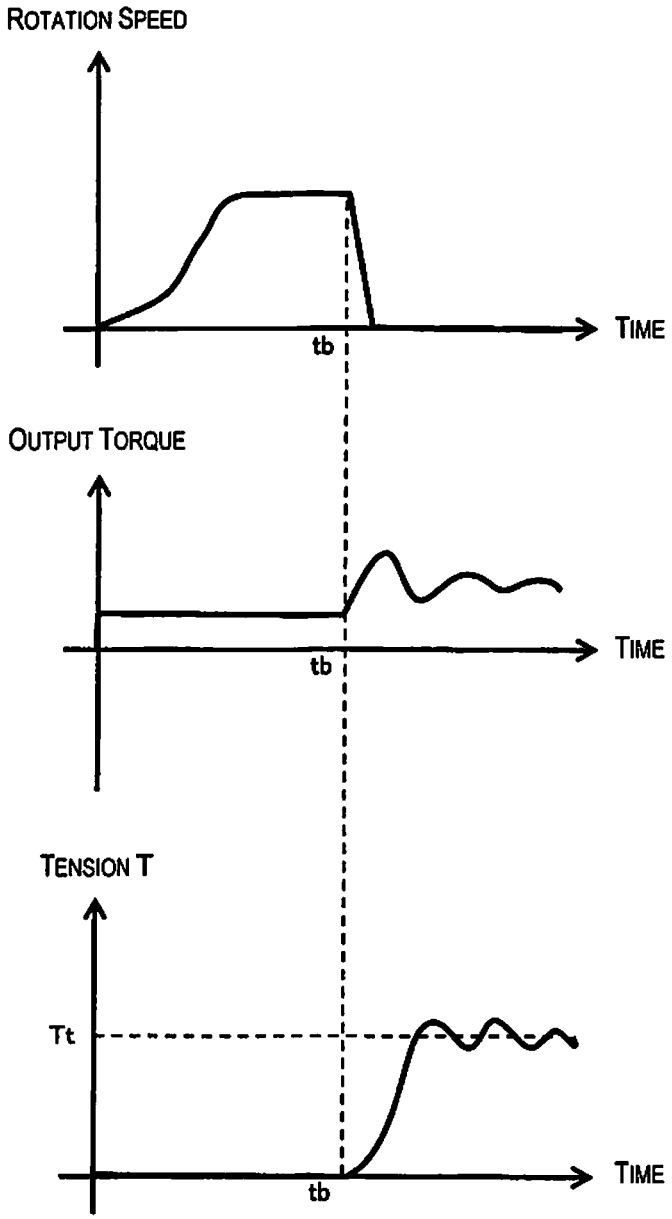
FIG. 6 is a drawing schematically showing an example of the action before and after the slack of the sheet is taken up.

We will give a detailed description of this point using FIG. 5 and FIG. 6. FIG. 5 and FIG. 6 are timing charts schematically showing an example of the action before and after the slack of the sheet S is taken up, where the top level shows the rotation speed of the rotating axles 20 and 40, the middle section shows the output torque of the motors M20 and M40, and the bottom section shows the tension T of the sheet S. In particular, FIG. 5 schematically shows an example when feedback control is performed on the tension T through before and after the slack of the sheet S is taken up, and FIG. 6 schematically shows an example when feedback control on the tension T is started from after the slack of the sheet S is taken up, the same as with this embodiment.

With the example shown in FIG. 5, feedback control is performed even during the time before time ta at which the slack of sheet S is taken up. During that time, the sheet S has slack, so it is not possible to give tension to the sheet S (bottom level in the drawing). Despite that, when the feedback control tries to reduce the deviation Δ, the output torque of the motors M20 and 40 continues to rise (middle section in the drawing). Because of that, the rotation speed of the rotating axles 20 and 40 continues to rise (bottom section in the drawing). Then, when the slack of the sheet S is taken up at time ta, a huge tension T that greatly exceeds the target tension Tt works on the sheet S (bottom section of the drawing). As a result, the feedback control cannot keep up with the application of a huge tension T, and the action from the time to and thereafter is vibrational (middle section and bottom section of the drawing).

In contrast to this, with the example shown in FIG. 6, feedback control is not executed during the time before the time tb when the slack of the sheet S is taken up, and the output torque of the motors M20 and M40 is fixed (middle section of the drawing). Because of that, the rotation speed of the rotating axles 20 and 40 is fixed after increasing to a certain level (upper section of the drawing). Therefore, the tension T that works on the sheet S at time tb at which the slack of the sheet S is taken up is suppressed to a level that slightly exceeds the target tension Tt, and it is possible to quickly restore the tension T to the target tension Tt using feedback control from time tb and thereafter. In this way, with this embodiment, it is possible to execute suitable control on the tension T of the sheet S according to whether it is before or after the slack of the sheet S has been taken up.

In particular, with this embodiment, until tension T greater than the designated value (zero) is detected by the tension sensors S21 and S41, the rotating axles 20 and 40 are rotated at a fixed torque. Said another way, until tension T greater than the designated value (zero) is detected by the tension sensors S21 and S41, open loop control is implemented. With this constitution, before the slack of the sheet S is taken up, this contributes to suppressing the rotating axles 20 and 40 rotating at high speed, and the sheet S being damaged.

Also, with this embodiment, when tension T greater than the designated value (zero) is detected by the tension sensors S21 and S41 for detecting the tension T of the sheet S, rotation of the rotating axles 20 and 40 is stopped. With this constitution, it is possible to take up the slack of the sheet S by rotating the rotating axles 20 and 40, and after the slack of the sheet S is taken up, the rotation of the rotating axles 20 and 40 is stopped, and it is possible to equip conveyance of the sheet S after reaching the state of the slack of the sheet S being taken up. In this way, it is possible to execute suitable control on the tension T of the sheet S according to whether it is before or after the slack of the sheet S has been taken up.

Also, with this embodiment, when conveying the sheet S, the rotating axles 20 and 40 are rotated at a relatively fast speed (first speed). On the other hand, when taking up the slack of the sheet S, the rotating axles 20 and 40 are rotated at a relatively slower speed (second speed) compared to the first speed, so the size of the tension T that acts on the sheet S at the moment the slack of the sheet S is taken up is suppressed, and it is possible to suppress the occurrence of damage to the sheet S and the like.

However, there are cases when the operator makes an error in the attachment orientation of the sheet S onto the rotating axles 20 and 40. In such a case, when the rotating axles 20 and 40 are rotated in the winding direction of the sheet S, the sheet S is not wound onto the rotating axles 20 and 40, but conversely is fed out from the rotating axles 20 and 40. In light of that, with this embodiment, when it is not possible to detect a tension T of the sheet S that is greater than the designated value (zero) even when the rotation of the rotating axles 20 and 40 continues for a designated time, the rotation of the rotating axles 20 and 40 stops. By doing this, it is possible to suppress to some degree the sheet S volume that is fed out from the rotating axles 20 and 40 along with rotation of the rotating axles 20 and 40 due to the attachment orientation of the sheet S being in error.

Furthermore, with this embodiment, when it is not possible to detect a tension T of the sheet S greater than the designated value even when the rotation of the rotating axles 20 and 40 continues for a designated time, the operator is given notification of an abnormality. By doing this, the operator becomes aware that there is an error in the attachment orientation of the sheet S, and it is possible to execute a suitable operation.

Second Embodiment

Next, we will describe the second embodiment. Here, we will give a description focusing on the difference points from the first embodiment, and for common points, correlating code numbers are given, and a description is omitted. With the second embodiment as well, by equipping constitutions common to the first embodiment, it goes without saying that the same effects are exhibited.

Figure 7:
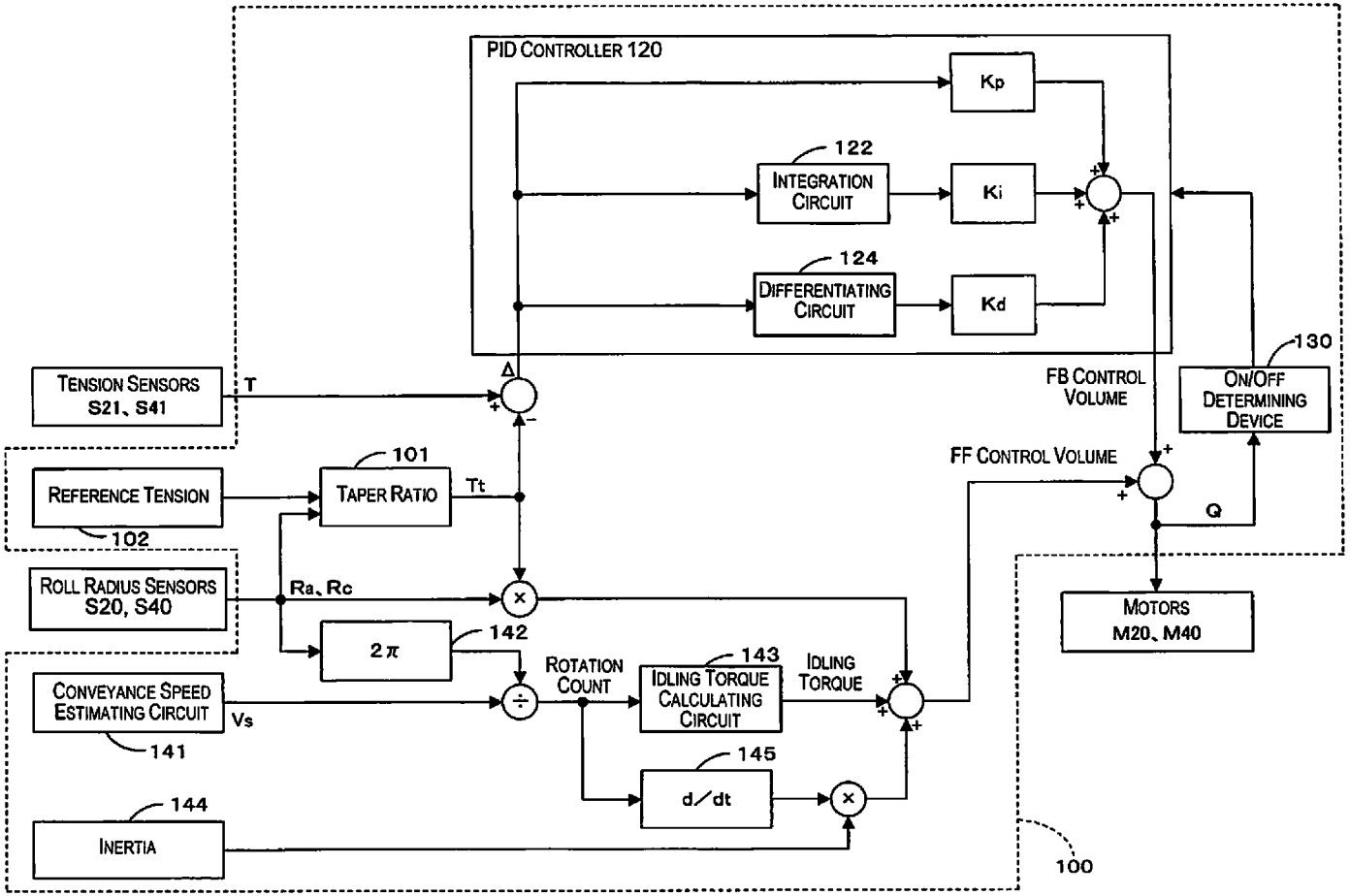
FIG. 7 is a drawing showing an example of the tension control with the second embodiment.

FIG. 7 is a block diagram showing an example of the feed tension and take-up tension control of the second embodiment. The constitution for controlling tension shown in FIG. 7 has the feed shaft 20 and the take-up shaft 40 provided individually, but since they are roughly the same, they will be described here together. As shown in the drawing, with the second embodiment, the On/Off determining device 130 performs On/Off control of the PID controller 120 based not on the tension T, but rather on the control volume input to the motors M20 and M40 (sum of the FB control volume and FF control volume), or said another way, the output torque of the motors M20 and M40. The details of the operation of this On/Off determining device 130 are as noted by example in FIG. 8.

Figure 8:
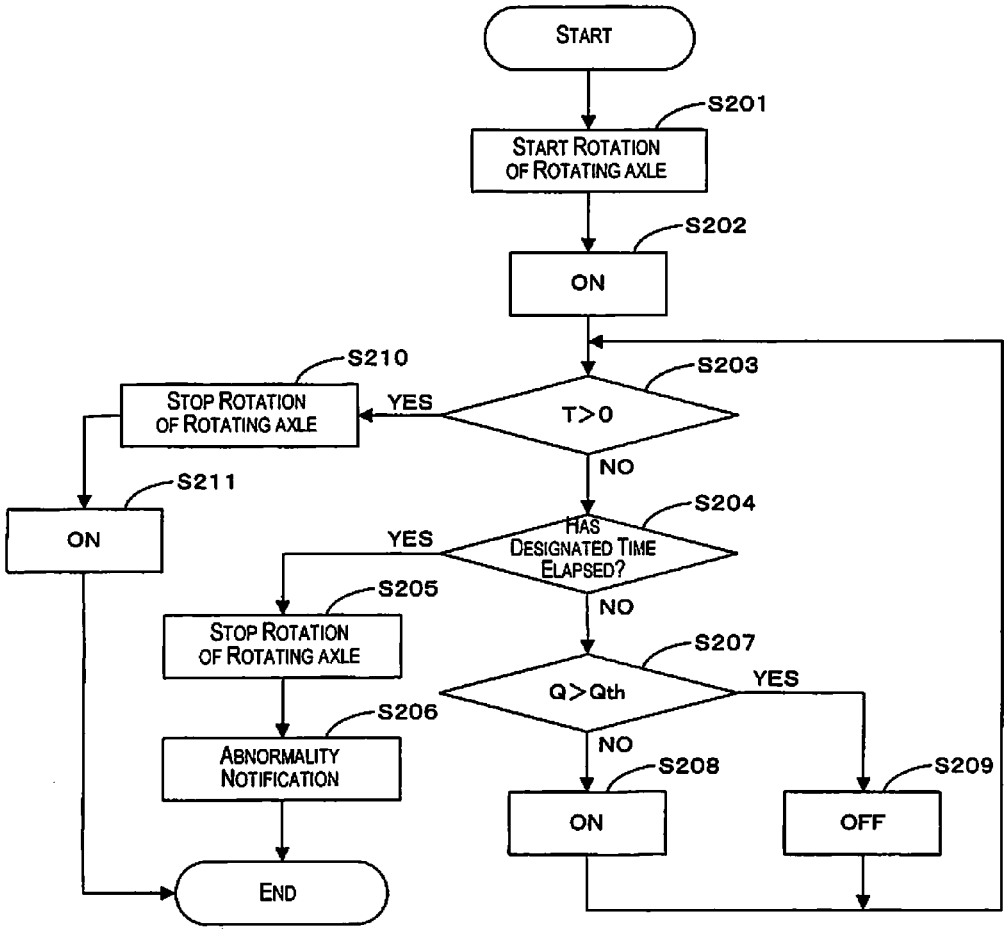
FIG. 8 is a drawing showing an example of the operation when the sheet is loaded with the second embodiment.

FIG. 8 is a flow chart showing an example of the operation executed by the printer control unit when the sheet is loaded on the rotating axle with the second embodiment. The operation shown in FIG. 8 is executed individually respectively on the feed shaft 20 and the take-up shaft 40, but these are roughly the same, so we will describe them together here.

When the sheet S is loaded on the rotating axles 20 and 40, the flow chart in FIG. 8 is executed.

At step S201, the rotation of the rotating axles 20 and 40 is started, and after that, the rotating axles 20 and 40 receive a fixed torque from the motors M20 and M40 and rotate. At this time, the rotation direction and speed of the feed shaft 20 or the take-up shaft 40 is as shown by example with the first embodiment. At step S202, the On/Off determining device 130 turns on the feedback control by the PID controller 120. By doing this, while feedback control is done for the tension T based on the tension sensors S21 and S41, the slack of the sheet S is taken up on the rotating axles 20 and 40. Step S202 is not limited to the timing shown by example here, and can be executed simultaneously with step S201 or before step S201.

Next, at step S203, the On/Off determining device 130 determines whether or not the tension T detected by the tension sensors S21 and S41 is greater than "0." Then, when taking up of the slack of the sheet S has not ended, and the tension T is equal to "0" (when "No" at step S203), the process advances to step S204, and a determination is made of whether or not the designated time has elapsed. The starting point of the designated time can be the timing of the start of rotation of the rotating axles 20 and 40, for example.

When it is judged that the designated time has elapsed (when "Yes" at step S204), the rotation of the rotating axles 20 and 40 is stopped (S205), and the operator is notified of an abnormality via the user interface 7 (step S206). The sequence of steps S205 and S206 is not limited to this, and they can also be simultaneous or be reversed in terms of before and after. Meanwhile, when it is judged that the designated time has not elapsed (when "No" at step S204), the On/Off determining device 130 determines whether or not the output torque Q to the rotating axles 20 and 40 from the motors M20 and M40 is greater than the designated torque Qth (step S207).

When the output torque Q is the designated torque Qth or less (when "No" at step S207), the On/Off determining device 130 turns on the PID controller 120 (step S208), and returns to step S203. On the other hand, when the output torque Q is greater than the designated torque Qth (when "Yes" at step S207), the On/Off determining device 130 turns off the PID controller 120 (step S209), and after starting open loop control on the torque given to the rotating axles 20 and 40, returns to step S203. When that control is executed, with the process of winding the slack sheet S onto the rotating axles 20 and 40, if the output torque Q is the designated torque Qth or less, feedback control of the tension T is executed, and when the output torque Q exceeds the designated torque Qth, feedback control of the tension T is stopped.

Also, when winding of the slack of the sheet S loaded on the rotating axles 20 and 40 ends, tension T is given to the sheet S. As a result, at step S203, the tension T is determined to be greater than "0." When this is received, the On/Off determining device 130 stops the rotation of the rotating axles 20 and 40 (step S210), and turns on the PID controller 120 (step S211). In this way, it is possible to support the sheet S on the rotating axles 20 and 40 while giving tension T that has undergone feedback control based on the detection values of the tension sensors S21 and S41. Furthermore, when doing conveying of the sheet S thereafter as well, it is possible to give to the sheet S tension T that has undergone feedback control based on the detection values of the tension sensor S21 and S41.

As described above, with this embodiment, when the torque Q given to the rotating axles 20 and 40 is the designated torque Qth or less, feedback control based on the detection values of the tension sensor S21 and S41 that detect the tension T of the sheet S is performed on the torque Q. On the other hand, when the output torque Q given to the rotating axles 20 and 40 exceeds the designated torque Qth, feedback control based on the detection values of the tension sensors S21 and S41 is not performed on the torque Q. With this constitution, feedback control is done on the torque Q given to the rotating axles 20 and 40 based on the detection values of the tension sensor S21, so it is possible to stabilize the tension T of the sheet S. In fact, the feedback control is executed when the torque Q is the designated torque Qth or less, and is not executed when that torque Q exceeds the designated torque Qth. By doing this, it is possible to suppress the torque Q from becoming excessive due to feedback control. In other words, for example in a state when the sheet S has slack, it is not possible to give tension T to the sheet S when the output torque to the rotating axles 20 and 40 is increased. Therefore, when feedback control is performed, despite being in a state for which it is not possible to given tension T to the sheet S because the sheet S is slack, the torque Q continues to increase in an attempt to give tension T to the sheet S, and as a result, the rotating axles 20 and 40 rotates at high speed, and a huge tension T works on the sheet S at the moment the slack of the sheet S is taken up, and there is the risk of damage to the sheet S. In contrast to this, when the torque Q exceeds the designated torque Qth, feedback control is not executed, and thus it is possible to suppress high speed rotation of the rotating axles 20 and 40, and damage to the sheet S.

Other

As described above, with the first embodiment noted above, the sheet S correlates to an example of the "web" of the present invention, the printer 1 correlates to an example of the "printing device" of the present invention, the feed shaft 20 or the take-up shaft 40 correlates to an example of the "rotating axle" of the present invention, the printer control unit 100 correlates to the "control unit" of the present invention, the tension sensor S21 or the tension sensor S41 correlates to an example of the "detector" of the present invention, and "zero" correlates to an example of the "designated value" of the present invention. Also, with the second embodiment noted above, the torque Qth correlates to an example of the "designated torque" of the present invention.

The present invention is not limited by the embodiments noted above, and various modifications can be added to the items described above as long as they do not stray from the gist. For example, with the first embodiment noted above, until the tension sensors S21 and S41 detected a tension T greater than the designated value (zero), the torque given to the rotating axles 20 and 40 were controlled to be constant. However, the torque control mode is not limited to this.

In light of that, it is also possible to have the rotating axles 20 and 40 rotate at a torque of the designated torque or less until the tension sensors S21 and S41 detect a tension greater than the designated value (zero), for example. At this time, the torque given to the rotating axles 20 and 40 does not necessarily have to be constant, and can also change within a range of the designated torque or less. With that constitution as well, it is possible to suppress high speed rotation of the rotating axles 20 and 40 and damage to the sheet S before the slack of the sheet S is taken up. Alternatively, it is also possible to have a constitution for which until a tension T for the sheet S which is greater than the designated value is detected, an attempt is made to rotate the rotating axles 20 and 40 at a torque that increases as time elapses. It is also possible to have a constitution by which the present invention is applied to on or the other of feeding out or winding up.

Also, at steps S103 and S203 of the embodiments noted above, the tension T was compared to "zero." However, the tension T comparison subject is not limited to being "zero," and can also be a "designated value" greater than "zero."

Also, with the embodiments noted above, after the slack of the sheet S is taken up and tension T (>0) is given to the sheet S, the rotation of the rotating axles 20 and 40 was stopped. In this way, it was not absolutely necessary to stop the rotation of the rotating axles 20 and 40, and after taking up the slack of the sheet S, it is also possible to move as is to conveying of the sheet S.

Also, with the embodiments noted above, we described a case when the present invention was respectively applied to the feed shaft 20 and the take-up shaft 40. However, it is also possible to apply the present invention only to one of the feed shaft 20 and the take-up shaft 40. It is possible to exhibit the effect of the present invention at least for the rotating axle to which the present invention is applied.

Also, with the embodiments noted above, the speed reducer 43 was provided between the take-up motor M40 and the take-up shaft 40. However, it is also possible to have a constitution for which torque is output to the take-up shaft 40 from the take-up motor M40 without going via the speed reducer 43.

Also, with the embodiments noted above, an integration operation, proportional operation, and differential operation were executed. However, it is not necessary to perform feedback control based on all of these operations, and it is also possible to exclude any of the operations.

Also, with the embodiments noted above, in addition to feedback control, feed forward control was executed. The specific constitution of this feed forward control can be suitably modified from the examples noted above. Alternatively, it is also possible to constitute this so as not to perform feed forward control.

Also, for the member supporting the conveyed sheet S, this is not limited to being a cylindrical shape such as the rotating drum 30 noted above. Therefore, it is also possible to use a flat platen that supports the sheet S on a flat surface.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A tension control method, comprising:

a first step of starting rotation of a rotating axle, which is configured to detachably support a web, in a direction in which the web is wounded onto the rotating axle;

a second step of performing open loop control on a torque applied to the rotating axle while feedback control on the torque applied to the rotating axle is being turned off;

a third step of detecting a tension applied to the web and comparing a detection value of the tension applied to the web with a designated value;

a fourth step of repeating the second step and the third step while the feedback control on the torque applied to the rotating axle is being turned off until the tension greater than the designated value is detected in the third step; and a fifth step of turning on the feedback control so that the feedback control is performed on the torque applied to the rotating axle based on the detection value of the tension applied to the web, after the fourth step.

2. The tension control method according to claim 1, further comprising rotating the rotating axle at a fixed torque until the tension greater than the designated value is detected in the detecting of the tension.

3. The tension control method according to claim 2, further comprising rotating the rotating axle at a first speed and conveying the web while the tension greater than the designated value is applied to the web, and rotating the rotating axle at a second speed smaller than the first speed until the tension greater than the designated value is detected in the detecting of the tension.

4. The tension control method according to claim 2, further comprising stopping the rotation of the rotating axle in the direction in which the web is wound onto the rotating axle in a case where the tension greater than the designated value is not detected in the detecting of the tension when the rotation of the rotating axle continues for a designated time.

5. The tension control method according to claim 4, further comprising notifying an abnormality in a case where the tension greater than the designated value is not detected in the detecting of the tension when the rotation of the rotating axle continues for a designated time.

6. The tension control method according to claim 1, further comprising rotating the rotating axle at a torque of a designated torque or less until the tension greater than the designated value is detected in the detecting of the tension.

7. The tension control method according to claim 1, further comprising rotating the rotating axle at a torque that is a designated torque or less and is a torque that increases as time elapses, until the tension greater than the designated value is detected in the detecting of the tension.

8. The tension control method according to claim 2, further comprising stopping the rotation of the rotating axle when the tension greater than the designated value is detected in the detecting of the tension.

9. The tension control method according to claim 1, wherein the feedback control is performed on the torque applied to the rotating axle based on the detection value of the tension applied to the web when the torque applied to the rotating axle is a designated torque or less in the performing of the open loop control, and the open loop control is performed on the torque applied to the rotating axle after the torque applied to the rotating axle exceeds the designated torque.

10. The tension control method according to claim 1, wherein during conveying of the web, the rotating axle is a feed shaft that feeds the web by rotating in a direction in reverse to the direction in which the web is wounded onto the rotating axle.

11. The tension control method according to claim 1, wherein during conveying of the web, the rotating axle is a take-up shaft that winds the web by rotating in the direction in which the web is wounded onto the rotating axle.

* * * * *